US009145230B2

(12) United States Patent
Madsen

(10) Patent No.: US 9,145,230 B2
(45) Date of Patent: Sep. 29, 2015

(54) STORAGE DEVICE COMPRISING TWO PARTS

(75) Inventor: Jens Ole Madsen, Bogense (DK)

(73) Assignee: TANOS GMBH VERPACKEN ORDNEN PRASENTIEREN, Neu-Ulm (DE)

( * ) Notice: Subject to any disclaimer, the term of this patent is extended or adjusted under 35 U.S.C. 154(b) by 1446 days.

(21) Appl. No.: 12/225,394

(22) PCT Filed: Apr. 20, 2007

(86) PCT No.: PCT/DK2007/000186

§ 371 (c)(1),
(2), (4) Date: Sep. 19, 2008

(87) PCT Pub. No.: WO2007/121746

PCT Pub. Date: Nov. 1, 2007

(65) Prior Publication Data

US 2010/0163562 A1 Jul. 1, 2010

(30) Foreign Application Priority Data

Apr. 22, 2006 (DK) ..... 2006 00568

(51) Int. Cl.

| | |
|---|---|
| ***B65D 85/62*** | (2006.01) |
| ***B65D 21/02*** | (2006.01) |
| ***B65D 43/02*** | (2006.01) |

(52) U.S. Cl.

CPC ..... *B65D 21/0212* (2013.01); *B65D 43/0212* (2013.01); *B65D 2543/0074* (2013.01); *B65D 2543/00194* (2013.01); *B65D 2543/00574* (2013.01); *B65D 2543/00629* (2013.01); *B65D 2543/00648* (2013.01); *B65D 2543/00694* (2013.01); *B65D 2543/00805* (2013.01); *B65D 2543/00842* (2013.01)

(58) Field of Classification Search

CPC ..... B65D 21/0212; B65D 43/0212; B65D 2543/00574

USPC ..... 220/324; 206/505, 506, 507

See application file for complete search history.

(56) References Cited

U.S. PATENT DOCUMENTS

| | | | | |
|---|---|---|---|---|
| 3,991,902 | A * | 11/1976 | Ford, Jr. | 220/324 |
| 5,100,015 | A * | 3/1992 | Vanderstuyf | 220/326 |
| 5,103,994 | A | 4/1992 | Doxey et al. | |
| 7,048,464 | B2 * | 5/2006 | Ronnquist | 403/321 |
| 2004/0099669 | A1 * | 5/2004 | Lown et al. | 220/324 |
| 2005/0035125 | A1 * | 2/2005 | Bae | 220/326 |
| 2006/0045815 | A1 * | 3/2006 | Hovatter | 422/104 |

FOREIGN PATENT DOCUMENTS

| | | |
|---|---|---|
| DE | 7828640 | 1/1979 |
| DE | 8108458 | 7/1981 |
| DE | 4201264 | 7/1993 |

(Continued)

*Primary Examiner* — Jeffrey Allen

(74) *Attorney, Agent, or Firm* — Hoffmann & Baron, LLP

(57) ABSTRACT

A storage device for coupling at least one box and at least one cover having a carrier grip, together is formed by a lock or a snap lock, which is provided in one gable or side wall of the cover or the box, while a locking pin is provided in the opposite gable or side wall. The snap lock is adapted to engage a gripper flange, which is provided at the top of the gable or side wall of the box or the cover, while the locking pin is adapted to engage a locking edge, which is provided in the opposite gable or side wall of the box or the cover.

6 Claims, 4 Drawing Sheets

(56) References Cited

FOREIGN PATENT DOCUMENTS

| | | |
|---|---|---|
| DE | 9406521 | 8/1994 |
| DE | 20020175 | 5/2002 |
| DK | PA 200401454 | 9/2004 |
| EP | 0555533 | 8/1994 |
| EP | 0799115 | 3/1999 |
| FR | 2841877 | 1/2004 |
| WO | WO 2007/121745 | 11/2007 |

* cited by examiner

STORAGE DEVICE COMPRISING TWO PARTS

This application claims priority based on an International Application filed under the Patent Cooperation Treaty, PCT/DK2007/000186, filed Apr. 20, 2007, and Danish patent application PA 200600568, filed Apr. 22, 2006.

BACKGROUND OF THE INVENTION

The invention relates to a storage device comprising two parts, such as two boxes or a box and a cover, which parts may be stacked and coupled together, wherein each part has two opposed gables and a coupling means at each gable for detachably coupling the two parts together in a stacked state, wherein the coupling means at the one gable of the one part is arranged to cooperate with the coupling means at the one gable of the other part, wherein the coupling means at the other gable of the one part is arranged to cooperate with the coupling means at the other gable of the other part, and wherein the coupling means of both parts at the one gable are formed by a first coupling means having a snap lock function. The invention moreover relates to use of the storage device.

Boxes having covers which may be coupled together are provided in several embodiments and sizes and are used in a multitude of connections. In particular for use as tool boxes, there are many types which are configured with various gadgets.

Boxes having covers are known, wherein covers and boxes may be coupled together in a mutual order by means of snap locks provided in the covers, and may thus be adapted to various needs.

The box systems thus known are extremely flexible, but may be vitiated by the drawback that the release of boxes and covers from each other is performed in that a user grips the snap locks in the gables of the boxes and/or the covers by both hands, which means that the weight of the boxes and the covers being released is transferred to the snap locks. To prevent breaking of these, they must therefore be made very sturdy.

SUMMARY OF THE INVENTION

Accordingly, an object of the invention is to provide a storage device for boxes having covers, where the weight of the cover or covers and/or the box or boxes is not transferred to the snap lock.

The object of the invention is achieved by a storage device of the type defined in the introductory portion of claim 1, which is characterized in that the coupling means of the two parts at the other gable are formed by a second coupling device, wherein both coupling means may be coupled together with and be detached from each other by lateral displacement of the two parts relative to each other.

Hereby, the cover and the box may be detached from each other by release of the snap lock, so that the entire weight is not transferred to the snap lock, since parts of the cover are supported by the box or the cover, while the snap lock is released.

It should also be noted that assembly and disassembly of the cover on/from the box takes place in a few seconds, and consequently is very time-saving and simple and convenient for a user to handle.

Expediently, as stated in claim 2, the two coupling means in said second coupling means are formed by a pin, which is provided in the lower portion of the other gable of the part disposed at the top of the stack, as well as an edge arranged to engage the pin, said edge being provided in the upper portion of the other gable of the part disposed at the bottom of the stack.

Hereby, a simple and effective attachment of the cover to the box is achieved when the snap lock is in engagement. The same will apply if it is desired to couple two boxes or two covers together.

To completely prevent transfer of any weight from the cover to the snap lock, it is advantageous if, as stated in claim 3, the cover is provided with a recessed carrier grip at its upper side, whereby the carrier grip absorbs the entire weight of the cover and the boxes and covers coupled together below the cover, which it might be desired to have removed from the underlying boxes and/or covers.

As stated in claim 4, it is expedient that the snap lock function is configured as a snap lock, which is configured as a moulded part in the gable or side wall of the cover or the box, which may engage the edge which is provided in the gable or the side wall of the cover or the box.

If a more sturdy, but also more expensive snap lock is desired, it is advantageous if, as stated in claim 5, the snap lock is formed by a gripper part which is spring-biased.

If, as stated in claim 6, the cover is provided with an edge at the top of both gables or side walls, and the cover is provided with a snap lock at the bottom of its one gable or sidewall and is provided with a locking pin in its other gable or side wall, and, as stated in claim 7, the box is provided with an edge at the top of both gables or side walls and with a snap lock at the bottom of the one gable and with a locking part at the bottom of the opposite gable, an arbitrary number of boxes and covers may be coupled together in a simple manner in an arbitrary order.

As mentioned, the invention also relates to use. This use is defined in claim 8.

The advantage of this use is that the costs of packaging, pallets, sheeting, shipment and storage space may be reduced considerably relative to the costs associated with tool boxes assembled at the factory, since a compact concept is involved here.

With this packaging system, combined with the extremely quick assembly concept, the costs may thus be reduced to 30-40% of the corresponding costs of tool boxes assembled at the factory.

BRIEF DESCRIPTION OF THE DRAWINGS

The invention will now be explained more fully with reference to the drawing, in which FIG. 6 shows the storage device according to the invention used in another embodiment, while

DETAILED DESCRIPTION OF THE PREFERRED EMBODIMENTS

Figure 1:
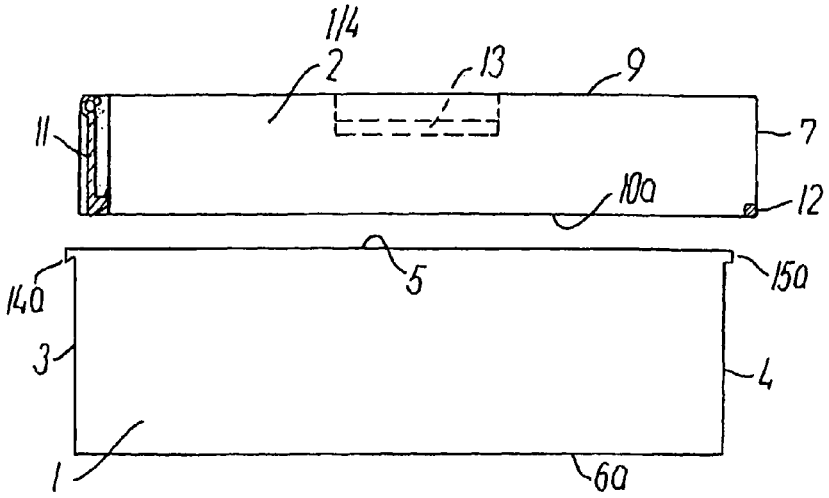
FIG. 1 shows a storage device according to the invention on a box having a cover, where the cover is separated from the box.
Figure 2:
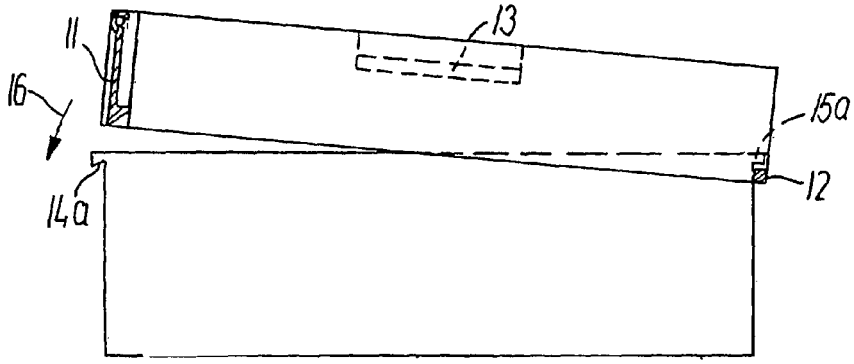
FIG. 2 shows the storage device of FIG. 1 during the coupling-together of the cover and the box.
Figure 3:
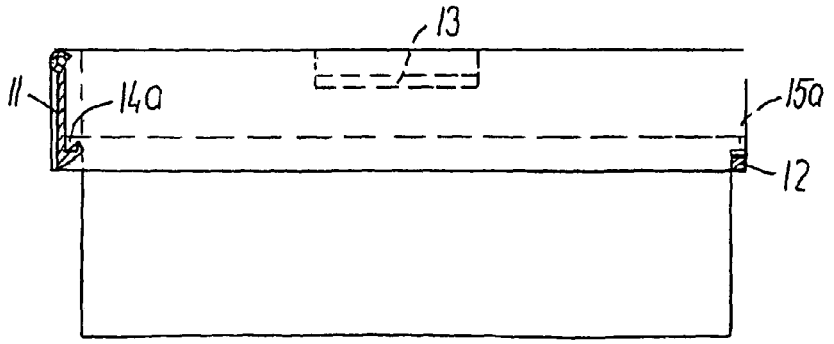
FIG. 3 shows the storage device of FIG. 1 and FIG. 2, where the cover and the box are coupled together.
Figure 4:
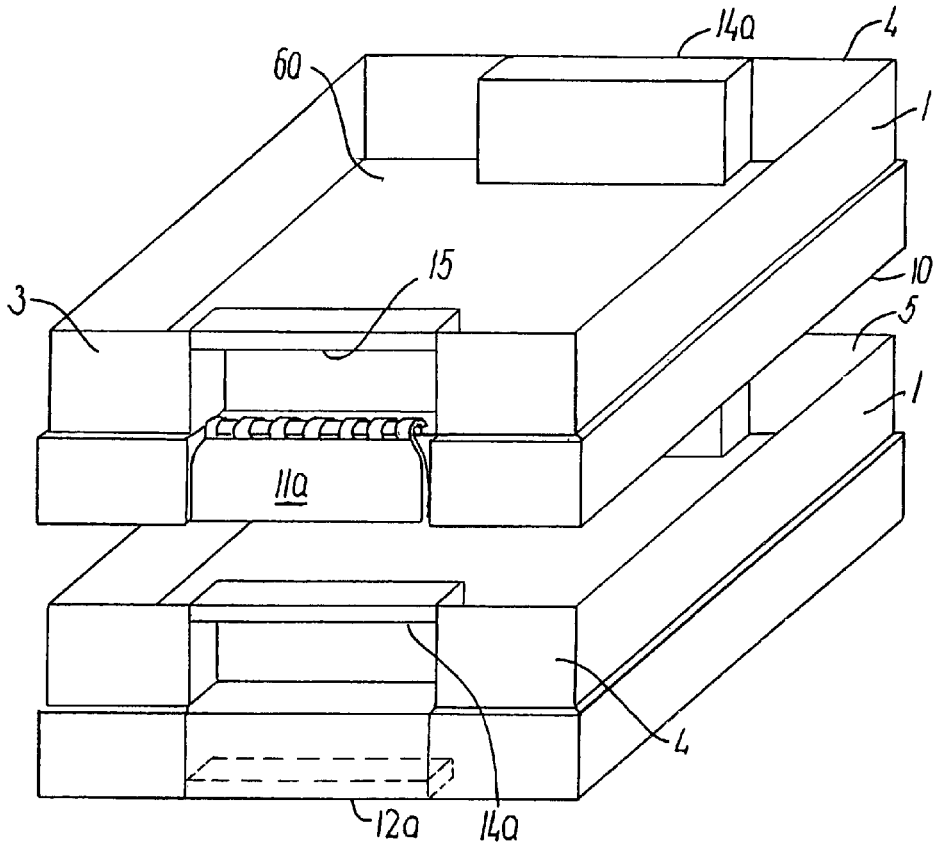
FIG. 4 shows a second embodiment of the invention, where two boxes are seen in perspective before they are assembled.
Figure 5:
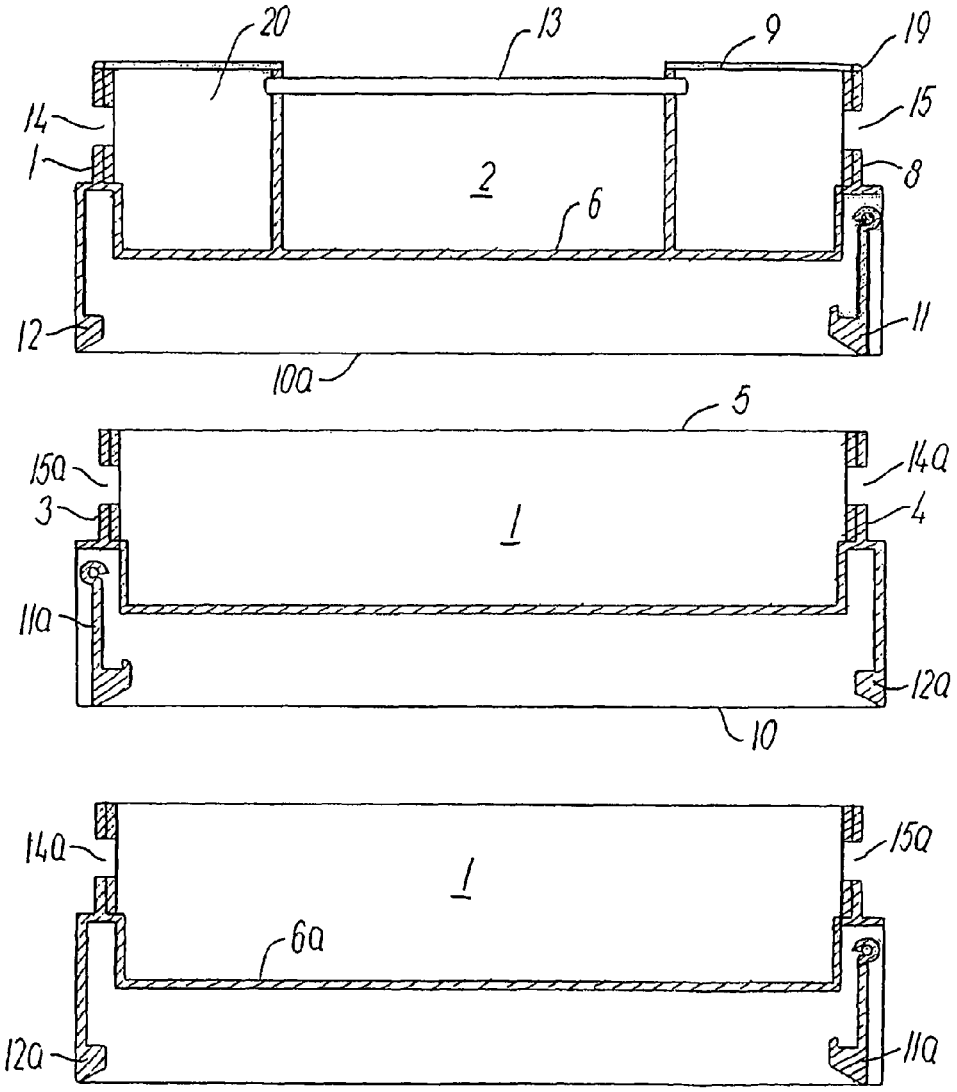
FIG. 5 shows a third embodiment seen from the side and how the storage device is configured with a cover and two boxes.

FIGS. 1-3 show a box having a cover, where there is only one set of locking means which cooperate on a box and a cover, while FIGS. 4 and 5 show boxes and covers, where cooperating locking means are provided both at the top and at the bottom of the boxes and the covers.

The figures show a box 1 which has gables 3, 4, a bottom 6*a*. In the gables of the box near the open upper part of the box, the gable 3 is provided with a coupling means in the form of a locking edge 15*a*, while the opposite gable 4 is provided with a coupling means in the form of a gripper flange 14*a*.

At the bottom of the gables of the box (only FIGS. 4 and 5), a coupling means in the form of a snap lock 11*a* is provided near the open lower part 10 of the box, while a coupling means in the form of a locking edge 12*a* is provided in its opposite gable.

The numeral 2 designates a cover which has gables 7, 8, a lid 9 and an open lower part 10*a* as well as a carrier grip 13.

A coupling means in the form of a locking pin 12 and another coupling means in the form of a snap lock 11 are provided at the bottom of the one gable of the cover, said snap lock having spring properties so that a hook on the snap lock is affected by a force directed inwardly against the gable.

A locking means in the form of a gripper flange 14 is provided at the top (only FIGS. 4 and 5) of the one gable of the cover, while another locking means in the form of a locking edge 15 is provided in the opposite gable.

Further, the cover may be provided with a lid 9, below which an insert part intended to store small tools, screws, nails and the like may be placed.

The mode of operation of the locking system will now be explained more fully with reference to FIGS. 1-3.

From the position shown in FIG. 1 where a user (not shown) has gripped the carrier grip 13, the gable 7 is moved down, so that the locking pin 12 engages the locking edge 15*a*.

Then, the cover 2 is pressed down in the direction of the arrow 16, following which the snap lock 11 engages the locking edge 14*a*, so that the cover 2 is secured to the box 1 by the locking system, which is formed by the snap lock 11, the locking pin 12, the gripper flange 14*a* and the locking edge 15*a*.

When, subsequently, the cover 2 is to be detached from the box, a user grips the carrier grip 13 by the one hand and releases the snap lock 11 from the gripper flange 14*a* by the other hand, following which the cover is lifted and displaced to the right, whereby the cover may be detached from the box.

When the cover is coupled together with and separated from the box, the cover remains in almost the same horizontal plane, as lateral displacements take place during the operations.

In addition, the snap lock 11 will never have to absorb the weight of the cover, which may optionally contain tools and the like.

The storage device according to the invention may be used in connection with the coupling-together of several boxes and covers of the type which is described in the applicant's above-mentioned DK Patent Application No. PA 2004 01454, as will be explained now in connection with FIGS. 6 and 7.

Figure 6:
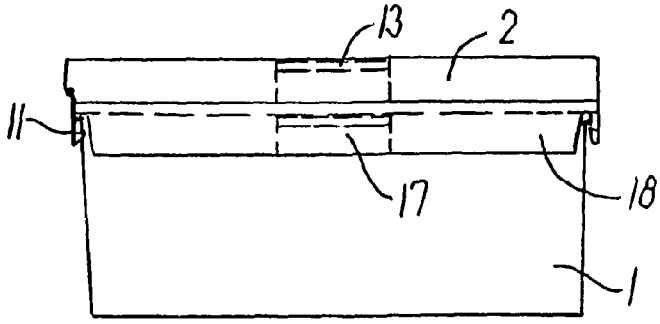

FIG. 6 shows a box system which consists of a box 1 with a mounted cover 2, and a tray 18 having a carrier grip 17 is arranged inside the box 1, where the tray may e.g. contain small tool parts, nails, screws and the like.

Figure 7:
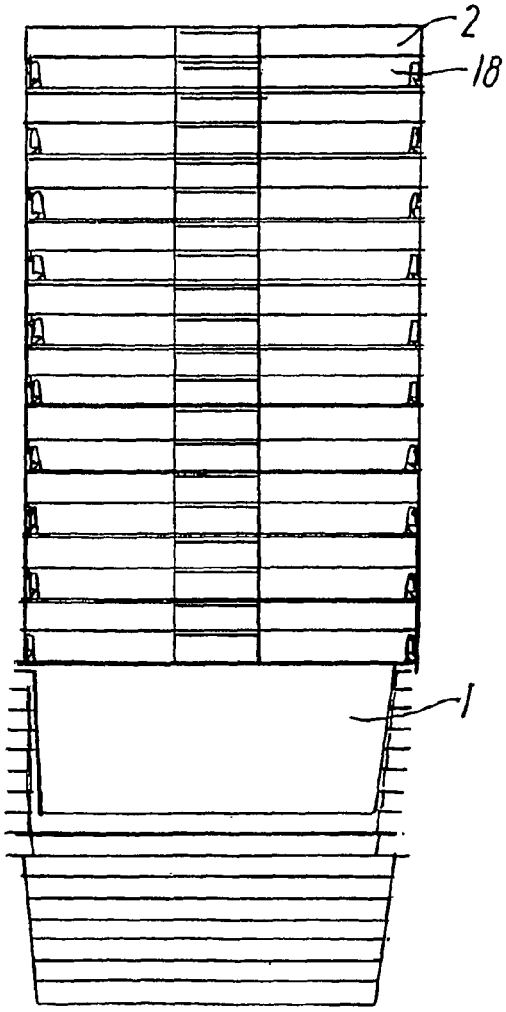
FIG. 7 shows how boxes and covers with the storage device of FIG. 4 may be stacked.

The box has obliquely inwardly extending walls, which means that they may be stacked as shown at the bottom of FIG. 7.

Moreover, the tray 18 may be moved into the cover 2 and be stacked as shown in FIG. 7.

Hereby, an extremely compact system is provided, which occupies minimum space during transport and during storage at wholesalers and at retailers.

Thus, just an assembled box with cover and tray, as shown in FIG. 6, need be displayed in a sales room, and when a consumer wants to buy a box with cover, he just takes a box from a first stack and then a cover with tray from a second stack, which may subsequently be coupled together in a few seconds by the locking system according to the invention.

The invention claimed is:

1. A storage device comprising an upper part and a lower part releasably stacked and coupled together:

said upper part comprising a horizontal base, opposed first and second gables extending vertically with respect to the base, a locking edge integrally formed with and extending outwardly from an upper portion of said first gable for detachably engaging coupling structure of an additional part from above, a snap lock having spring properties disposed at a lower portion of said first gable opposite said locking edge, a gripper flange integrally formed with and extending outwardly from an upper portion of said second gable for detachably engaging coupling structure of an additional part from above and a locking pin disposed at a lower portion of said second gable opposite said gripper flange, said locking edge not being part of said snap lock at said first gable and said gripper flange not being part of said locking pin at said second gable; and said lower part comprising a horizontal base, opposed first and second gables extending vertically with respect to the base, a gripper flange integrally formed with and extending outwardly from an upper portion of said first gable for detachably engaging said snap lock of said upper part, a locking pin disposed at a lower portion of said first gable opposite said gripper flange for detachably engaging coupling structure of an additional part from below, a locking edge integrally formed with and extending outwardly from an upper portion of said second gable for detachably engaging said locking pin of said upper part and a snap lock having spring properties disposed at a lower portion of said second gable opposite said locking edge for detachably engaging coupling structure of an additional part from below, said locking edge not being part of said snap lock at said second gable and said gripper flange not being part of said locking pin at said first gable, wherein, upon releasing the snap-lock of the upper part from the gripper flange of the lower part, the upper and lower parts are free for lateral horizontal displacement relative to each other and with respect to the base of each part, and wherein the locking pin of the upper part and the locking edge of the lower part may be coupled together with and be detached from each other by said horizontal lateral displacement of the two parts relative to each other, and wherein the upper and lower parts can be completely separated when only said snap-lock is actuated, and wherein the base of the upper part rests upon and is supported by the upper portion of the first and second gables of the lower part when the upper and lower parts are stacked and coupled together such that the weight of the upper part is not transferred to the snap lock.

2. A storage device according to claim 1, wherein at least one of the two parts is a cover, and wherein the cover is provided with a recessed carrier grip at its upper side.

3. A storage device according to claim 1, wherein the snap lock is configured as a molded part in the gable or side wall of the respective part, which may engage the edge which is provided in the gable or side wall of the other respective part.

4. A storage device according to claim 1, wherein at least one of the two parts is a box.

5. A storage device as defined in claim 1, wherein each snap lock comprises a gripper part which is spring-biased against said gable for alternately engaging and disengaging said gripper flange.

6. A storage device as defined in claim 1, wherein each of said upper and lower part is provided with an edge defining an open upper part of each of said upper and lower part, wherein said locking edge and said gripper flange are formed at said edge.

* * * * *